United States Patent [19]

Kurth et al.

[11] Patent Number: 4,544,927

[45] Date of Patent: Oct. 1, 1985

[54] WIDEBAND BEAMFORMER

[75] Inventors: Richard R. Kurth, Sudbury; Robert A. Gabel, Acton, both of Mass.

[73] Assignee: Sperry Corporation, New York, N.Y.

[21] Appl. No.: 439,258

[22] Filed: Nov. 4, 1982

[51] Int. Cl.[4] ..... H01Q 3/22; H01Q 3/24; H01Q 3/26

[52] U.S. Cl. ..... 343/373; 343/371; 343/375

[58] Field of Search ..... 343/373, 372, 375, 368, 343/371; 367/135

[56] References Cited

U.S. PATENT DOCUMENTS

| | | | |
|---|---|---|---|
| 3,484,785 | 12/1969 | Sheldon et al. | 343/373 X |
| 3,510,871 | 5/1970 | Watanabe et al. | 343/373 X |
| 3,763,490 | 10/1973 | Hadley et al. | 343/375 |
| 3,840,875 | 10/1974 | Neal | 343/373 X |
| 4,112,430 | 9/1978 | Ladstatter | 343/368 |
| 4,263,600 | 4/1981 | Williams et al. | 343/372 |
| 4,290,127 | 9/1981 | Pridham et al. | 343/372 X |

OTHER PUBLICATIONS

K. Steiglitz, "Design of FIR Digital Phase Networks," Proceedings of 1980 Intl. Conf. Acoust., Speech, and Signal Proc., Denver, Colorado, pp. 252–255.

R. A. Gabel, "On Asymmetric FIR Interpolators with Minimum Lp Error," Proceedings of 1980 Intl. Conf. Acoust., Speech, and Signal Proc., Denver, Colorado, pp. 256–259.

R. A. Gabel, "On the Performance of Equiripple FIR Interpolating Filters," Proc. of Fourteenth Asilomar Conf. on Circuits, Systems, and Computers, Nov. 1980.

R. A. Gabel, "On the Design and Performance of Equiripple IIR Interpolators," Proceedings of 1981 Intl. Conf. Acoust., Speech, and Signal Proc., Atlanta, Georgia, pp. 232–235.

F. J. Brophy and A. C. Salazar, "Two Design Techniques for Digital Phase Networks," Bell Syst. Tech. J., vol. 54, Apr., 1975, pp. 767–781.

A. Chottera and G. A. Jullien, "Designing Near Linear Phase Recursive Filters Using Linear Programming," Proc. of 1977 Intl. Conf. on Acoust., Speech, and Signal Proc., Hartford, Conn., pp. 88–92.

*Primary Examiner*—Theodore M. Blum
*Assistant Examiner*—Brian S. Steinberger
*Attorney, Agent, or Firm*—Howard P. Terry; Seymour Levine

[57] ABSTRACT

A beamformer that accommodates signals of substantially wider bandwith than conventional phase-shift beamformers by processing signals coupled from an array of sensor elements in a multi-stage sequence of operations that alternate between phase-shift beamforming and time-delay steering.

5 Claims, 13 Drawing Figures

WIDEBAND BEAMFORMER

BACKGROUND OF THE INVENTION

1. Field of the Invention

The present invention relates to beamforming by receiving signals with sensors in an array, and more particularly to beamforming with such arrays when wideband signals are received.

2. Description of the Prior Art

Sonar, radar, communications, seismological prospecting, and tomography systems employ arrays of spatially distributed sensors which sample physical quantities such as pressure or electromagnetic fields and convert these quantities to electrical signals. These electrical signals are processed to produce a second set of signals that enhance wave arrivals from selected directions, while discriminating against wave arrivals from other directions, thereby forming beams in the selected directions. This process is known in the art as beamforming and the network to which the sensors are coupled is known as a beamforming network. Signals from the sensor coupled to the beamforming network may be continuous or sampled analog waveforms or they may be sampled and digitized to establish digital signals. Beamforming with analog signals requires that each signal be time delayed in accordance with the desired beam direction and the position of the receiving sensor in the array, amplitude weighted in accordance with the beam shape desired, and added with the other signals to form a beam output signal. These time delays, weightings, and sum operations are generally duplicated for each selected beam direction. When the signals received by the sensors are at frequencies within a narrow band centered about a carrier frequency $f_0$, the required delay operations may be performed by lumped constant phase-shift circuits that provide phase shifts in accordance with $\phi=2\pi f_0\tau_k$, where $\tau_k$ is a function of the selected direction and k is an integer index corresponding to the receiving sensor.

Sensor output signals may be directly sampled or may first be hetrodyned to a convenient intermediate frequency and then sampled. Alternatively, a pair of signals may be derived which represent the in-phase and quadrature signal components relative to the carrier frequency $f_0$, each such signal being sampled. The signal sample pairs thus produced may be considered a complex-valued signal sample $S_k(n\Delta t)$, derived from the kth array element, where n is the time sample index and $\Delta t$ the sample period. For receptions which are narrowband about the carrier frequency $f_0$, these time-sampled signals are phase-shifted and summed to form a beam in accordance with $$B_m(n\Delta t) = \sum_k S_k(n\Delta t)a_k e^{j\phi_{km}}$$

where $B_m(n\Delta t)$ is the mth beam output signal, $S_k(n\Delta t)$ is the sampled signal from the kth sensor, $a_k$ is the weighting or shading factor for the signal from the kth sensor, and $\phi_{km}$ the phase-shift value required to phase-align the signal from the kth sensor with the signals from all the other sensors for the mth beam selection direction. It is well known that the sampling rate $(\Delta t)^{-1}$ must exceed the bandwidth W of the sensor output signal about the carrier frequency.

Signal samples produced by a uniform plane wave at the carrier frequency, arriving at an angle $\theta$, at the kth element of an array of K sensors linearly positioned with uniform spacing of d wavelengths at the center frequency $f_0$ may be represented as $S_k(n\Delta t)=Ae^{-j2\pi kd \sin\theta}$ where A is the wave amplitude. If the sensor signals are subjected to phase shifts $\phi_{km}=(2\pi km)/K$ applied thereto and then summed, m being a constant that may take on the values 0, 1, 2, . . . , (K-1), the array will be steered to couple signals from the sensors for summations that are of equal phase for plane wave fronts at the carrier frequency arriving at angles defined by $\theta_m=\sin^{-1}(m/Kd)$. With this phase gradient the sum of the sample signals $B_m(n\Delta t)$ becomes $$B_m(n\Delta t) = \sum_{k=0}^{K-1} S_k(n\Delta t)a_k e^{\frac{j2\pi km}{K}}$$

which is well known in the art as the discrete Fourier tranform (DFT). When the frequency band of the signals $S_k$ received at the sensors is sufficiently broad about the carrier frequency, beam steering as described above fails to operate properly since the phase shift values at the elements, though based on the propagation delays of the wave front as it crosses the array, do not provide proper phase shifts for signal components at frequencies sufficiently far removed from the carrier.

Consider steering a uniform colinear array to a direction $\theta_m=\sin^{-1}(m/Kd)$ for a wave at the carrier frequency $f_0$. The phase shifts required for the kth sensor in the beamforming process are thus $$\phi_{km} = 2\pi f_0 k \sin\theta_m \frac{d\lambda}{c} = \frac{2\pi km}{K}$$

where $\lambda=c/f_0$ is the wavelength at the carrier frequency and c is the wave propagation speed. When the wave arriving from $\theta_m$ has a temporal frequency $f_0+\Delta f$, it induces a relative phase shift at the kth sensor of $$-\frac{2\pi km}{K}\left(1+\frac{\Delta f}{f_0}\right),$$

and the phase shifter at each element no longer exactly compensates for the propagation-induced phase shift. In fact a beam for a selected angle $\theta_m$ under the assumption of the frequency $f_0$, is steered to the angle $$\theta = \sin^{-1}\left[\sin\theta_m/\left(1+\frac{\Delta f}{f_0}\right)\right]$$

for an incident wave at frequency $f_0+\Delta f$. This defocusing effect causes the response of the phase-shift beamformer to encompass a broader spatial angle, provides a diminished beam amplitude, and causes adjacent beams to smear together, resulting in a loss of directional resolution. Thus the maximum scan angle of a phase-shift steered array is a function of the array size and the operating signal bandwidth W, the maximum scan angle being given approximately by $$|\sin\theta_m| \leqq [KdW/f_0]^{-1} \cong (WT_a)^{-1}$$

where $T_a$ is the time required for a wave traveling parallel to the array elements to traverse the array and $T_aW$ is a fill-time/bandwidth product for the array.

The fill-time/bandwidth product scan angle limitation has been overcome in the prior art with sampled data versions of delay and sum beamforming. In one method sensor signals are sampled at a rate much faster than that required by the signal bandwidth, and beams are formed by selecting sensor samples corresponding to the required sensor delays for the desired beam angle of arrival. Another method utilized in the prior art, as described by R. G. Pridham and R. A. Mucci, "A Novel Approach to Digital Beamforming", Journal of the Acoustical Society of America, volume 63, pp. 425–434, February 1978, performs sampling at a rate that is slower than the above mentioned sampling rate to form estimates of the sensor signal samples at the desired delays via interpolation. Though these beamforming methods exhibit satisfactory performance with wideband signals, they are considerably more complex and expensive to build than phase-shift beamformers.

SUMMARY OF THE INVENTION

The present invention relates to a beamformer coupled to an array of sensor elements for operation with a signal bandwidth that exceeds the band limits, for the overall length of the array and maximum scan angle, over which conventional phase-shift beamforming may be employed. The beamformer includes a first beamforming stage that comprises a multiplicity of conventional phase-shift beamformers each coupled to contiguous elements of the array to form a multiplicity of subarrays. Sector beams are formed for each of these subarrays in the first beamforming stage, such that sector beam directions are scanned in parallel through a plurality of sectors within the overall scanning range of the system. Each sector beam output signal from the first stage phase-shift beamformers is coupled to a time delay stage wherein signals are time delayed by interpolation in accordance with the subarray position in the overall array and the sector scan angle to establish delay alignment at the respective subarray output terminals of the time delay interpolator for each sector beam steering direction. The signals at the output terminals of the time delay interpolator are then coupled to a third stage comprising a conventional phase-shift beamformer which forms beams at selected scan angles within each sector beam.

This technique may be utilized to construct beamformers having more than three stages (e.g. five, seven, etc.), alternating between time-delay alignment and phase-shift steering after the third stage of the beamformer. This arrangement establishes sub-sectors scanned within each sector and sub-sub-sectors scanned within each sub-sector. The total number of sub-divisions of the angular space is dependent upon the number of time-delay/phase-shift combination sections added after the third stage.

DESCRIPTION OF THE PREFERRED EMBODIMENTS

Figure 1:
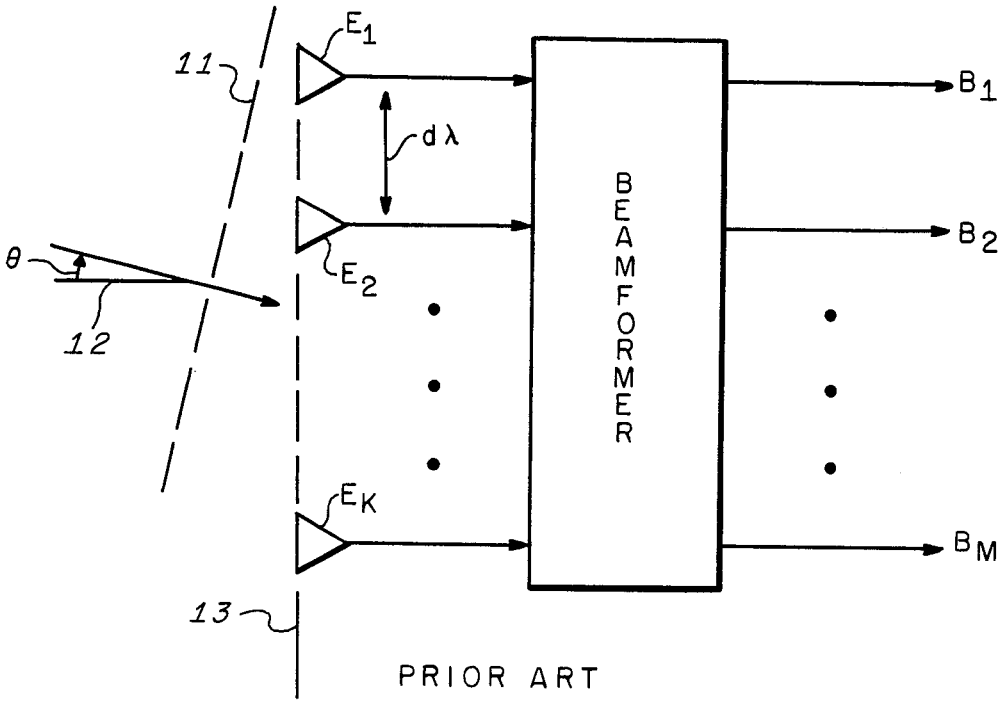
PRIOR ART FIG.1.
FIG. 1 is a block diagram of a beamformer having a multiplicity of sensor elements and a plurality of beam output terminals.

In FIG. 1 is illustrated a beamformer of the prior art wherein an array of sensor elements $E_1$ through $E_K$ are colinearly positioned with the uniform spacings $d\lambda$, where $\lambda$ is the wavelength at the band center or carrier frequency $f_0$. Though these beamformers are generally employed for arrays with uniform spacing, non-uniform spacing with elements positioned on a uniform grid, but not all the grid positions being filled by an element, have also been utilized in the prior art. Directional responses of the elements in the array are usually identical and may generally be factored from the overall beamformer directional response. In determining this overall beamformer directional response each sensor element may be considered to yield a complex-valued time-sampled signal sequence $S_k(n\Delta t)$ for the kth sensor, such signals having frequency components within the range $\pm W/2$ arising from frequency components in the receptions within the range $f_0 \pm W/2$, and sampled at a frequency $1/\Delta t$ which is W plus an anti-aliasing margin. The scanning range of these arrays is limited by the inverse fill-time/bandwidth factor $(WT_a)^{-1}$ where $T_a = Kd\lambda/c$, c being the propagation velocity of the signal in the array environment.

A plane wave with temporal frequency $f_0 + \Delta f$ having a uniform phase front 11 arriving at an angle $\theta$ with respect to the normal 12 to the plane 13 of the array of elements $E_1$ through $E_K$ induces a signal at each element that may be represented as:

$$S_k = Ae^{-j2\pi dk\sin\theta\lambda(f_0+\Delta f)/c}$$

where A is the amplitude of the plane wave. In the beamformer an amplitude factor $a_k$ and a phase shift $(2\pi km)/K$ are applied to each of the element signals, the resulting signals then being summed to form M beams ($M \leqq K$) such that a signal for the mth beam appears at an output terminal, the sum at that output terminal being $$B_m = \sum_{k=0}^{K-1} Aa_k e^{-j2\pi k[d\sin\theta\lambda(f_0+\Delta f)/c - m/K]}$$

Figure 3:
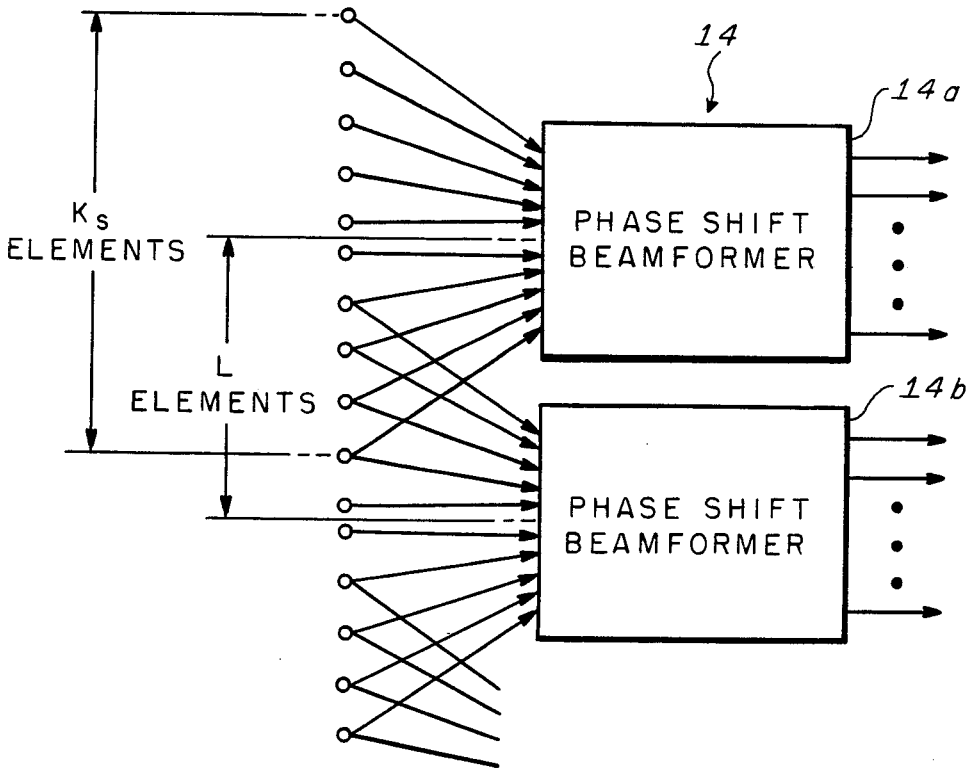
FIG. 3 is a block diagram of a sensor element array coupled to a plurality of conventional phase-shift beamformers forming a first stage of the preferred embodiment of the invention.
Figure 2:
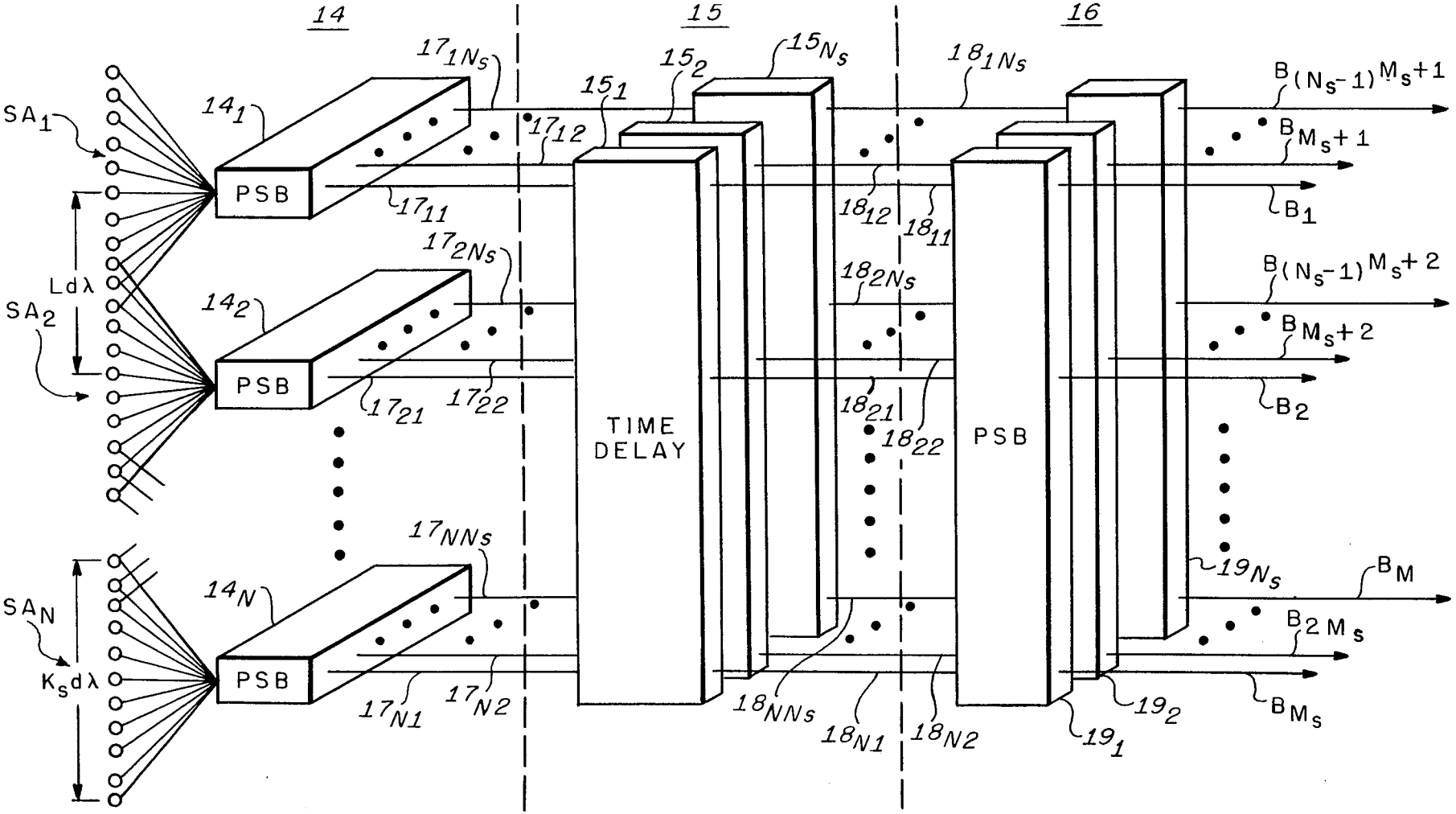
FIG. 2 is a block diagram of a preferred embodiment of the invention.

The beamformer of the present invention comprises a multiplicity of stages, as for example the three stages shown in FIG. 2. The first stage 14 may be divided into N phase-shift beamformers, each coupled to a subarray of $K_s$ elements with subarray centers uniformly spaced by Ld wavelengths, i.e. by L-element spacings as shown in FIG. 3. The number of elements $K_s$ in each subarray may exceed the number of element L spacing of the subarray centers, whereby the subarrays will overlap and share some elements. Consequently the full array is comprised of $K=(N-1)\ L+K_s$ elements uniformly spaced by $d\lambda$. The elements of each subarray are coupled to beamformers $\mathbf{14}_1$ through $\mathbf{14}_N$, each of which may be of the discrete Fourier transform type well known in the art, wherein identical phase-shift beamforming is performed on the $K_s$ signals from the elements comprising each subarray to produce a set of $N_s(N_s \leqq K_s)$ subarray output beams for each subarray steered in directions corresponding to $N_s$ sectors, which collectively span the entire field of view of interest, with the peak direction of corresponding sector beams of each subarray being in a parallel relationship. It will be recognized that the maximum scanning angle of these parallel beams is limited in substantial accordance with $$|\sin \theta_{N_s}| \leqq f_0/K_s dW$$

However, this limitation is dependent upon the subarray aperture of $K_s d$ wavelengths so that the latter may be selected to provide a set of sector beams spanning the entire field of view of interest without violating the limitation over the operating bandwidth W.

The second stage 15 in the beamformer subjects the subarray beam output signals to time delays that provide proper time alignment of the subarray beams for each sector steering direction.

After the subarray beam output signals for each sector are suitably delayed in the second stage of the beamformer, each of the so delayed N subarray beam output signals may be phase-shift steered in a beamformer of the discrete Fourier transform type in a third stage 16 to produce $M_s$ full-resolution beams within each directional sector, thus providing a total of $M=N_sM_s$ beam signals at the output terminals of the beamformer. Each of the M beams thus produced has a directional resolution that is determined by the overall array aperture. Each beam has a nominal width in sin $\theta$ space of 1/Kd with beam separations of 1/Kd. Such beam coverage is normally associated with exclusive phase-shift beamforming. Thus, the composite beamformer provides the coverage of a phase shift beamformer over a significantly wider signal band.

Figure 4:
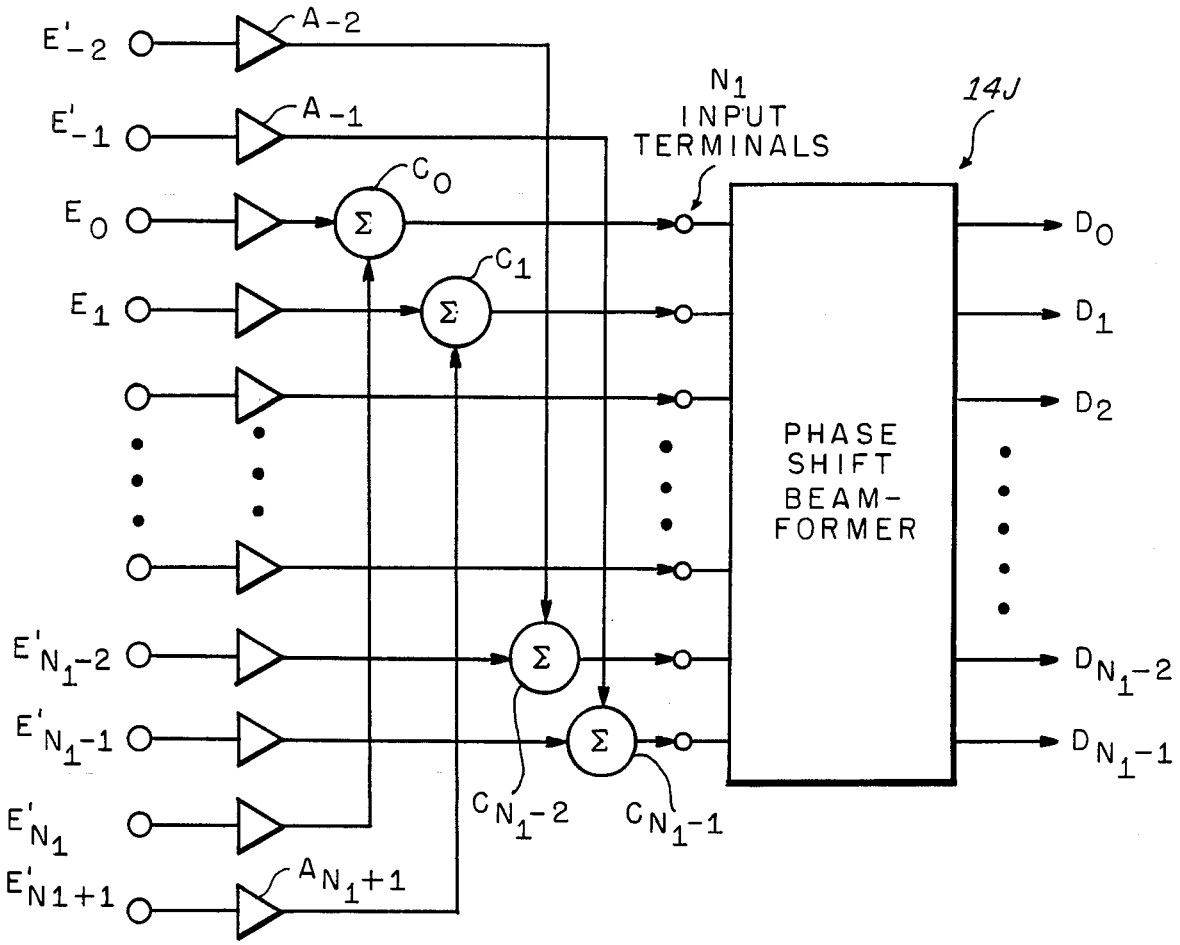
FIG. 4 is a block diagram of a discrete Fourier transform beamformer having a greater number of sensor elements coupled thereto than there are input terminals thereof and a generally lesser number of beam output terminals than input terminals.

All the subarray phase-shift beamformers $\mathbf{14}_1$ through $\mathbf{14}_N$ in the first stage are to steer beams, with main lobe directional responses that each cover a sector, to provide the overall angular coverage desired. Consequently each subarray aperture in wavelengths ($K_s d$) must be substantially equal to the inverse of sin $\theta_s$, where $\theta_s$ is the sector beam width. When the beamformers $\mathbf{14}_1$ through $\mathbf{14}_N$ are of the DFT type the signal at the kth element in each subarray is phase-shifted by $2\pi mk/N_1$, where m is the sector beam index and $N_1$ is the number of input terminals to the DFT beamformer ($N_1$ point DFT). If more than $N_1$ equally spaced elements are employed in the array, as for example $E'_{-2}$ through $E'_{N1+1}$ elements shown in FIG. 4, the phase difference to be induced between the elements j and $j+N_1$ is substantially $2\pi m$. Consequently the signal phases to be induced between elements separated by $N_1$ element positions are substantially equal, thus permitting the paired addition of these signals in summation circuits $C_0$, $C_1$, $C_{N1-2}$, and $C_{N1-1}$, as shown in FIG. 4 after the application of the weighting factors to the signals by amplifiers $A_{-2}$ through $A_{N1}+1$ and prior to coupling to an appropriate input port of phase-shift beamformer 14J. Thus, the $K_s$ elements of each subarray form uniformly spaced sector beams that establish signals at the output terminals of the beamformer in accordance with $$D_m(n\Delta t) = \sum_{k=k_1}^{k_2} s_k(n\Delta t) a_k e^{+j2\pi mk/N_1}$$

where the summation is performed over index valves corresponding to all elements in the subarray. The peak sector beam response occurs at an angle $\Psi m$ that is determined from $\sin \Psi m = {}^m/N_1 d$.

Figure 5:
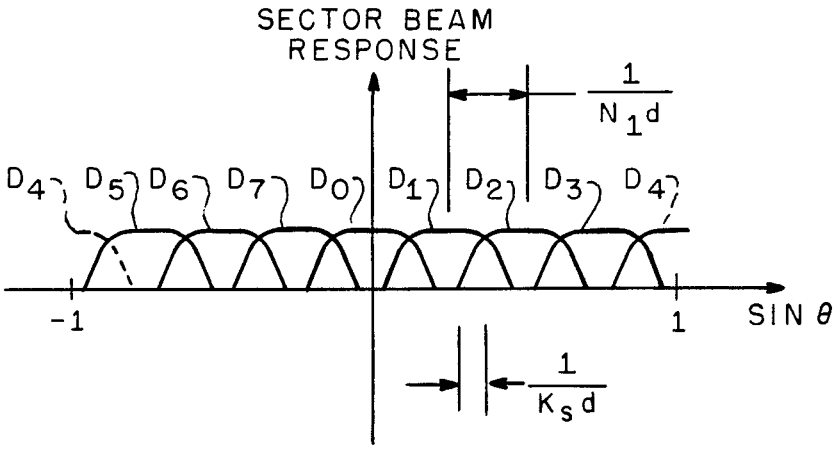
FIG. 5 is an illustration of the sector beams available from the beamformer of FIG. 4.

Representative directional responses for an eight point DFT beamformer for which $K_s$ is greater than $N_1=8$, and for which weighting factors have been choosen for beam broadening, are shown in FIG. 5. In sin $\theta$ space the beam separation is $1/N_1 d$, while each beam exhibits a nominal transition width of $1/K_s d$. Though eight representative beams are shown, not all need be utilized and the number of sector beams $N_s$ may be fewer than the number of steering angles $N_1$ available. Not shown in the figure are any grating lobes at multiples of 1/d which may be associated with the subarray patterns. It is well known that array parameters may be selected to avoid subarray sector beam grating lobes in directions from which wave arrivals may be expected. Consistent with FIG. 4, wherein $K_s$ exceeds $N_1$, the transition width of each beam in FIG. 5 is shown to be less than the beam spacing. If, however, $K_s=N_1$ the transition widths and the peak spacings would be substantially equal.

Subarray beamforming as discussed above may be implemented with arithmetic, logic, and memory devices when the simultaneously sampled sensor element signals are digitzed by one or more analog to digital (A/D) converters. The DFT has a highly regular structure which may be exploited in the construction of hardware This hardware is fully described in the literature and may be found in "Theory and Application of Digital Signal Processing" by Rabiner and Gold published by Prentice Hall, Inc., Englewood Cliffs, N.J. Particularly efficient circuit architectures are known for special values of the DFT parameter $N_1$, e.g., when it is a power of two or a product of prime numbers. Alternatively, when the sensor signals are sampled but not digitized, circuits such as charge-transfer devices may be employed to accomplish the DFT, or when the signals are not sampled, the well-known Butler Matrix may be utilized to efficiently implement the phase-shift beamforming process.

Referring again to FIG. 2, the output signals from the $N_s$ sector beams at the output terminals of PSB $\mathbf{14}_1$ are coupled via lines $\mathbf{17}_{11}$ through $\mathbf{17}_{1N_s}$ to time-delay circuits $\mathbf{15}_1$ through $\mathbf{15}_{N_s}$, while the output signals from the $N_s$ sector beams at the output terminals of PSB $\mathbf{14}_2$ through $\mathbf{14}_N$ are respectively coupled to time-delay circuits $\mathbf{15}_1$ through $\mathbf{15}_{N_s}$ via lines $\mathbf{17}_{21}$ through $\mathbf{17}_{2N_s}$ and $\mathbf{17}_{N1}$ through $\mathbf{17}_{N\ N_s}$ respectively. In these time-delay circuits $\mathbf{15}_1$ through $\mathbf{15}_{N_s}$ subarray beam output signals for each of N sets of parallel beams, for example the subarray beam output signals coupled via lines $\mathbf{17}_{11}$ through $17_{N1}$, are time-delayed to compensate for wave front arrival delays according to the sector steering angles $\Psi_m = \sin^{-1}(m/N_1 d)$.

Figure 6:
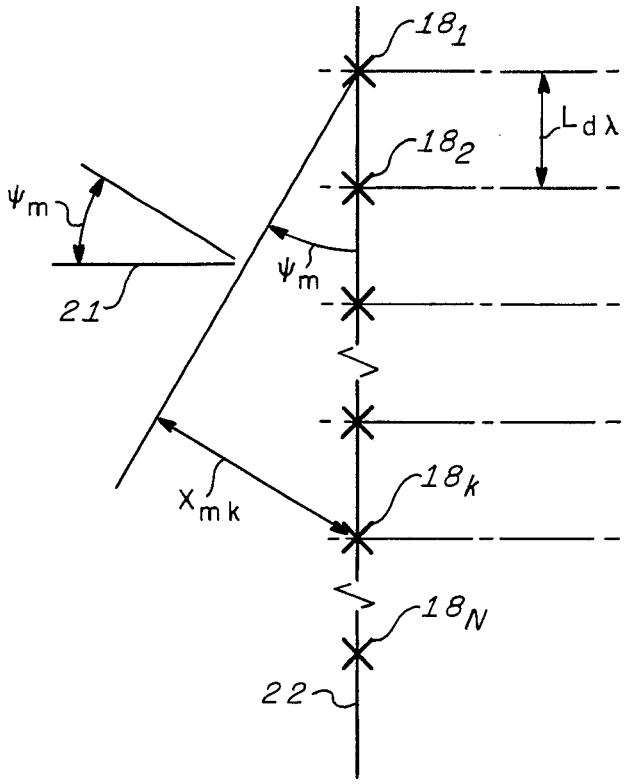
FIG. 6 is a diagram useful in the explanation of the time delay applied to each sector beam output.
Figure 7:
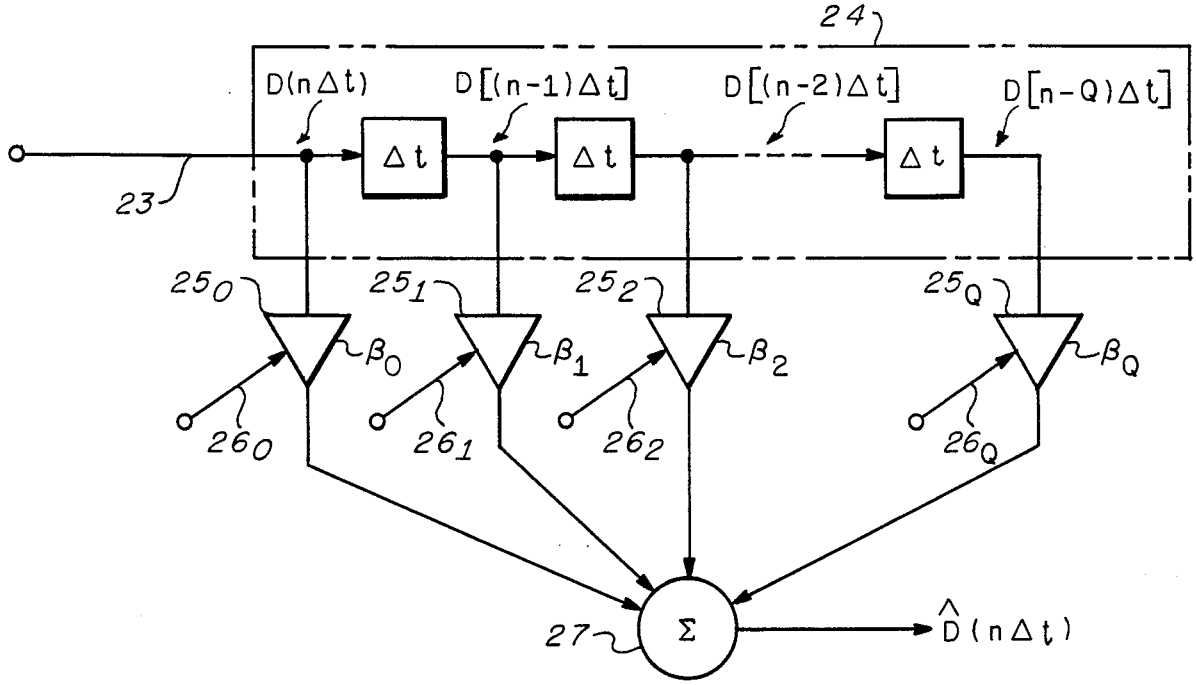
FIG. 7 is a block diagram of a time-delay interpolation circuit.

Referring to FIG. 6, wherein the centers $18_1$ through $18_N$ of each of the subarrays $SA_1$ through $SA_N$ of FIG. 2 are shown, the relative time delay to be applied to the output signal for the mth sector beam of the kth subarray is thus $$\begin{aligned}\tau_{mk} &= \tau_o - X_{mk}/c \\ &= \tau_o - (\sin\psi_m)kLd\lambda/c \\ &= \tau_o - mkL/N_1 f_0 \text{ sec.}\end{aligned}$$

where $\Psi_m$ is the sector beam angle relative to the normal 21 to the array surface 22, $X_{mk}$ is the wavefront displacement distance and $\tau_o$ is an arbitrary time offset applied to the output signals of all subarrays for the sector beam under consideration. These time delays may be provided by interpolating the subarray sector beam output signals to the time instants specified above and repeating such interpolation in each successive sampling period. In FIG. 7 a block diagram of a circuit for performing this interpolation is shown. The sector beam output signal $D(n\Delta t)$ is coupled to input terminal 23 wherefrom samples are coupled to a tapped delay line 24, which may be a shift register, tapped at intervals of $\Delta t$. Each of the delayed samples in the delay line may be coupled respectively to amplifiers $25_0$ through $25_Q$, having gains that may be programmed by via leads $26_0$ through $26_Q$ in accordance with the desired interpolation delay, to provide the proper weighting factors for a postulated delay functionality. These weighted samples are coupled to summation network 27 wherefrom an output signal $D(n\Delta t)$ representative of the delayed input $D(n\Delta t)$ is provided. The time-delay interpolation as discussed above may be implemented with arithmetic, logic, and memory devices which perform the weighted sum of delayed subarray sector beam output samples as shown in FIG. 7. This circuitry may be arranged in the form of a digital filter. Alternatively, analog sampled-data filters such as those utilizing charge-transfer or switched-capacitor devices may be employed for the delay interpolation.

Figure 8:
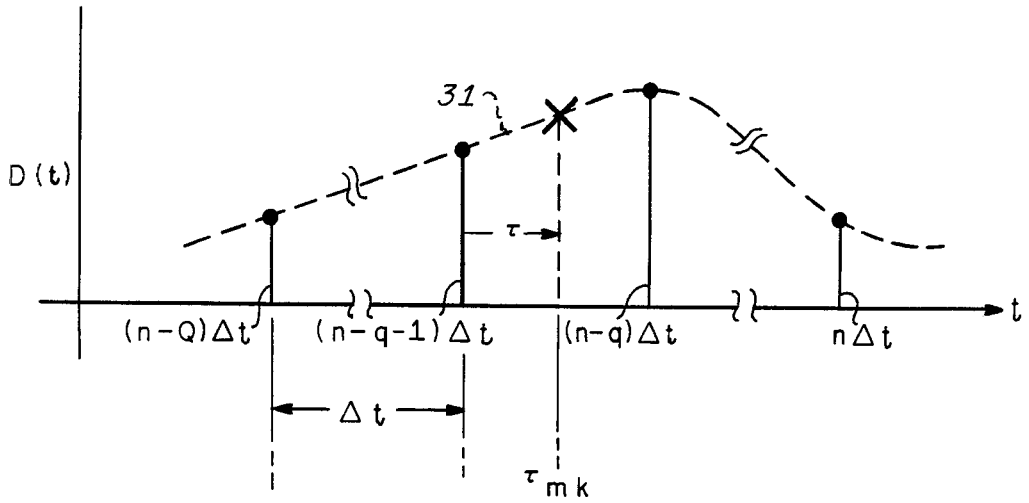
FIGS. 8 and 9 are graphs that are useful for explaining the interpolation coefficients shown in FIG. 7.
Figure 9:
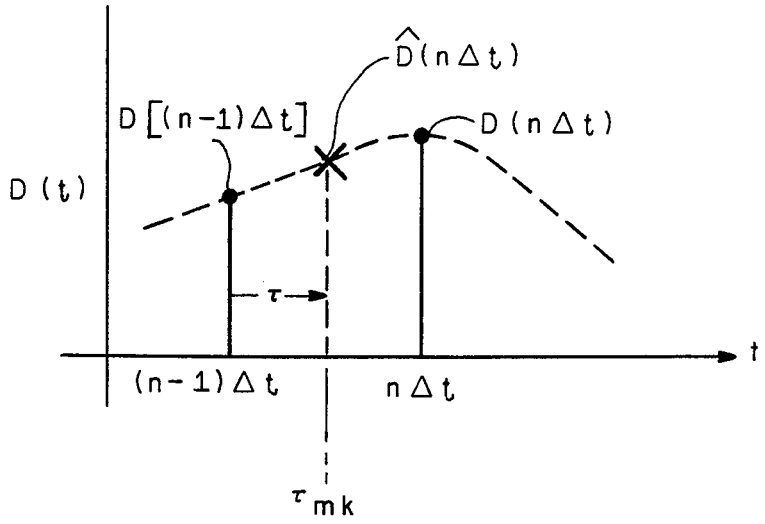

Referring now to FIG. 8, assume that an interpolation for time $\tau_{mk} = (n-q-1)\Delta t + \tau$ is desired and that the functionality is as shown by the dotted curve 31. The weighting coefficients $\beta_k$ realized by the amplifier gains in FIG. 7 are selected so that the output of the delay interpolation network approximates $D(\tau_{mk})$, the functionality at the desired delay. For example, if two samples of sector beam output are combined by linear interpolation for a desired delay of $\tau_{mk} = (n-1)^{\Delta t} + \tau$ as shown in FIG. 9, then $$B_o(\tau_{mk}) = \tau/\Delta t = \alpha$$

$$B_1(\tau_{mk}) = 1 - \tau/\Delta t = 1 - \alpha$$

$$\hat{D}(n\Delta t) = \alpha D(n\Delta t) + (1-\alpha)\, D[(n-1)\Delta t]$$

The principles of designing delay interpolation networks are well-known, for example as discussed in "A Comparison of Equiripple FIR and IIR Interpolators", by R. A. Gabel, Proceedings of the 1981 Asilomar Conference on Circuits, Systems, and Computers, November 1981, pp. 55–59.

Referring again to FIG. 2, each set of delayed subarray beam outputs for each sector are coupled from time delay circuits $15_1$ through $15_{N_S}$ to phase-shift beamformers $19_1$ through $19_{N_S}$ respectively, e.g. time delayed signals are coupled from the time delay circuit $15_1$ via lines $18_{11}$ through $18_{N1}$ to the phase-shift beamformer $19_1$. Each set of N delayed subarray output signals $D_k$ may be applied to a $N_2$-point DFT to form $N_2$ beams within each sector in accordance with $$Y_l(n\Delta t) = \sum_{k=0}^{N_2-1} D_k(n\Delta t) b_k e^{j2\pi kl/N_2}$$

where l is the index for the output beams in that sector and the $b_k$ are coefficients which shape the third stage beam patterns and include the factors $\exp(j2\pi KLd \sin \Psi m)$. The latter provide subarray center carrier phase shift compensation of the delayed sector beam signals $D_K(n\Delta t)$ for the sector beam steering angle $\Psi m$. Since the spacing of the subarrays is $Ld\lambda$, the DFT phase-shift beamformers $19_1$ through $19_{N_S}$ each provide signals at the outputs thereof representative of $N_2$ beams within a sector that are pointed in directions relative to each sector steering direction in $\sin\theta$ space that are determined from $$\sin\theta_m = \frac{m}{N_2 Ld}$$

From the $N_2$ output beam signals thereby produced in each sector, $M_s (M_s \leqq N_2)$ of these beam signals are coupled to the respective output terminals in FIG. 2, e.g. $Y_l(n\Delta t)$ for the first sector to $B_1$ through $B_{M_s}$. The field of view in $\sin\theta$ space covered by the $M_s$ final output beams in each sector should not exceed the scan angle limitation $f_0/KdW$.

Figure 10:
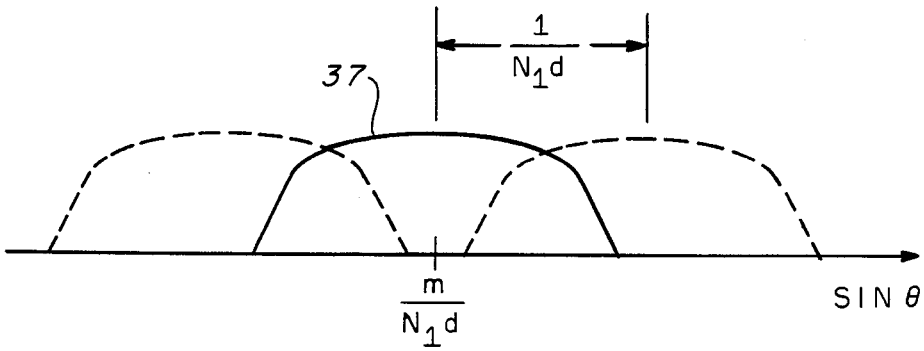
FIGS. 10, 11, and 12 are illustrations useful for describing sector information and beamformation within a sector.
Figure 11:
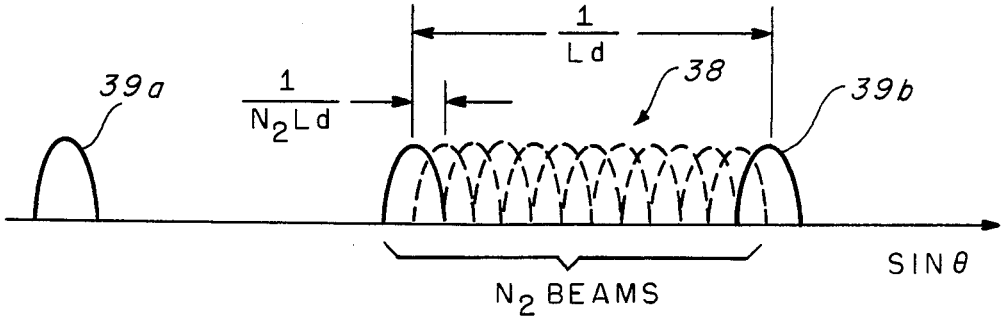
Figure 12:
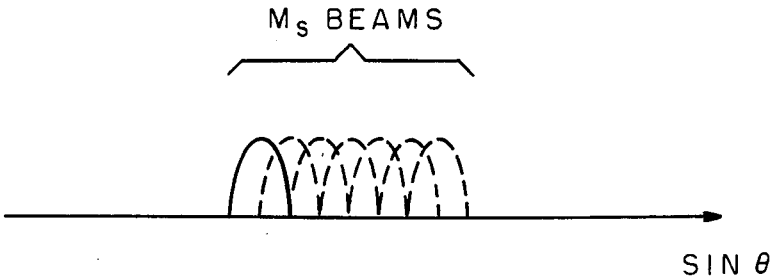
Figure 13:
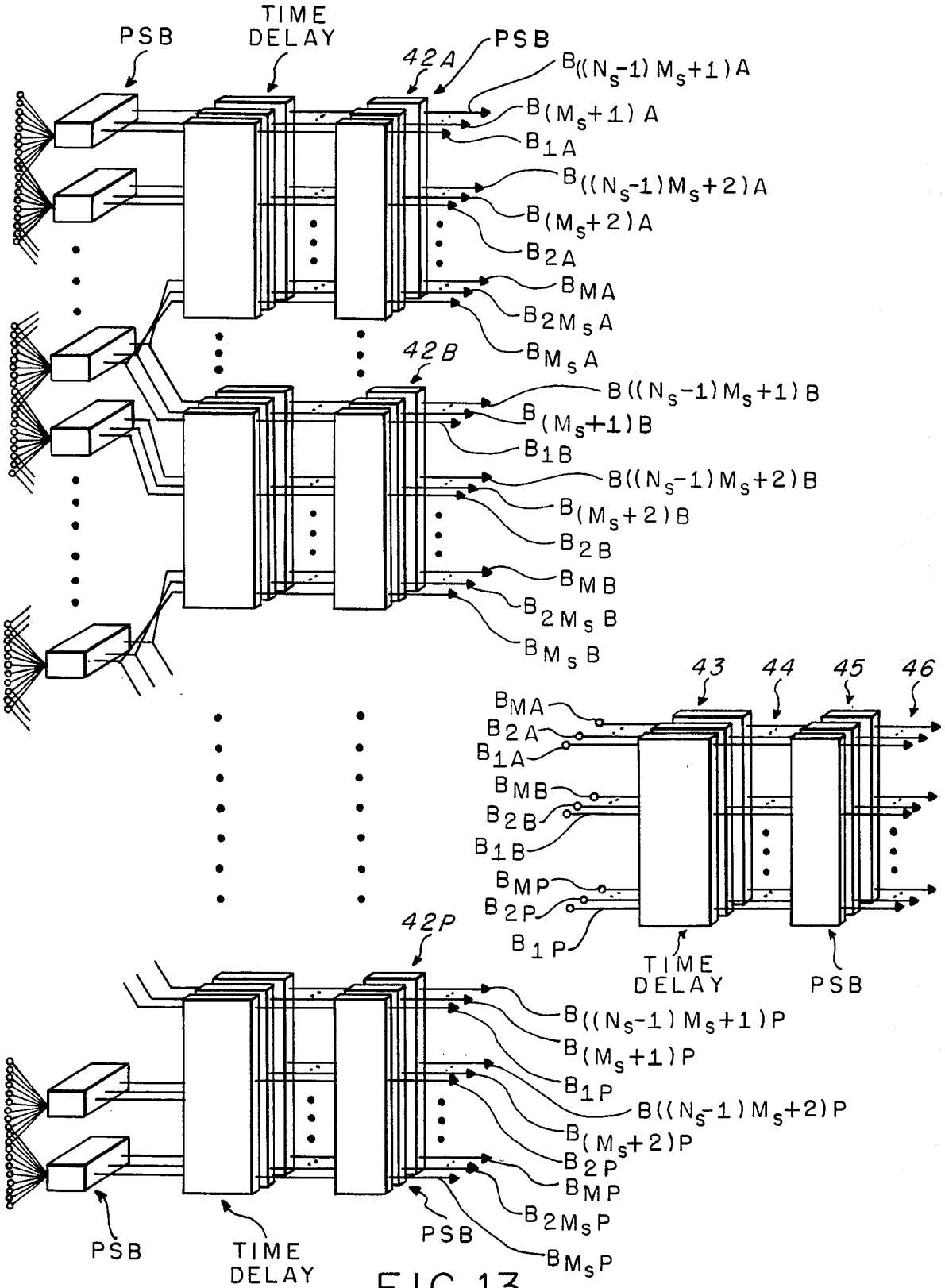
FIG. 13 is a block diagram of a preferred embodiment of the invention employing more than three stages.

In FIG. 10 a sector beam directional response 37 is shown along with additional sector responses spaced by $1/N_1 d$, while in FIG. 11 a set of patterns 38 for the $N_2$ possible beams produced by the DFT of the third stage phase-shift beamformer is shown. Since the subarray phase centers are separated by $Ld\lambda$, each third stage beamformer pattern exhibits grating lobes typified by 39A and 39B at multiples of $1/Ld$ in $\sin\theta$ space, falling, however, outside of the sector response 37. $M_s$ of the $N_2$ available third stage DFT output signals for each sector are selected about the center of the sector as final output beams in that sector, as illustrated in FIG. 12. This operation is repeated in all sectors to establish an ensemble of $M = N_s M_s$ full-resolution output beams that uniformly span the directional space coordinate $\sin\theta$. It should be apparent to one skilled in the art that the $M_s$ beams in a sector formed by the third stage will continuously span the entire space when $N_2 L = N_1 M_s$. The subarray size, element spacing, weighting coefficients, and first stage DFT parameters should be selected to be compatible with this principle of operation.

The invention has been described in terms of a beamformer constructed of three stages comprising a subarray sector beamsteering phase-shift network, a subarray sector beam output delay-alignment network, and a subsector phase-shift beamforming network. By decomposing the array into several orders of generally overlapping subarrays and the beam angle space into several orders of sectors, beamformers of this type may be constructed having more than three (e.g., 5, 7, 9, etc.) stages, alternating between phase-shift steering and time-delay alignment. For example, as shown in FIG.

13, the $N_SM_S$ output ports of a multiplicity of third stage beamformers 42A through 42P may be coupled to a second set of time delay circuits 43, forming a fourth stage of the system. Corresponding beam ports from the beamformer sets 42A through 42P are coupled to a common time delay unit; as for example, the first beam ports $B_{1A}$ through $B_{1P}$ of each beamformer set 42A through 42P are coupled to inputs of the first time delay unit of 43, and the last beam ports $B_{M_SN_SA}$ (BMA) through $B_{M_SN_SP}$ (BMP) of each beamformer set 42A through 42P are coupled to inputs of the last time delay unit of 43. The output ports 44 of each time delay unit may then be coupled to a plurality of phase shift beamformers, forming a fifth stage, to provide the desired beams at the output ports 46 of the beamformers, as previously described.

It will be noted by those skilled in the art that the principles of the invention above described may be applied to construct a beamformer for a two-dimensional array of sensors lying in a common plane and located on a regular grid, e.g., a rectangular grid with uniform spacings in each dimension, which may be different for each dimension. In this case the first beamforming stage phase-shift steers signals from identical subarrays to a set of sector steering directions. The planar array is thereby decomposed into generally overlapping, geometrically regular (e.g. rectangular) subarrays. The first stage phase-shift steering is to a set of sector directions uniformly spaced in the two-directional coordinates, so that it may be accomplished by efficient implementation of two-dimensional Fourier transform operations. Subarray sector beams are then properly time-aligned by interpolation according to sector steering directions and the subarray phase-center locations. The third stage in the beamformer is sub-sector phase-shift steering of the two-dimensional set of subarray beams in each sector. Two-dimensional Fourier transform operations may also be employed to perform this function. The beamformer operating principles may be extended to regularly spaced three-dimensional arrays in a similar fashion.

It will be recognized by those skilled in the art that the invention as described may utilize reciprocal elements and as such may be employed as a receiving or a transmitting beamformer.

While the invention has been described in its preferred embodiments, it is to be understood that the words which have been used are words of description rather than limitation and changes may be made within the purview of the appended claims without departing from the true scope and spirit of the invention in its broader aspects.

We claim:

1. A wideband beamformer comprising:

first beamforming means having means for coupling to an array of sensor elements for forming sets of sector beams numbering N, each set having a number $N_S$ of sector beams, equal for all sets, each sector beam covering an angular sector, thereby providing a total of $NN_S$ sector beams, said sector beams of said sets being in a one-to-one correspondence with corresponding sector beams covering like angular sectors and said sector beams of each set in totality spanning an angular region and for providing signals representative of said sector beams at output terminals, said output terminals being in one-to-one correspondence with said $NN_S$ sector beams for providing time delays to said sector beam representative signals for time aligning representative signals of corresponding sector beams; and second beamforming means having input terminals coupled to receive said time aligned sector beam representative signals for providing phase-shifts to said time aligned sector beam representative signals to form sub-sector beams, numbering $M_S$, within and angularly spanning each sector beam, thereby providing $M_SN_S$ sub-sector beams.

2. A wideband beamformer in accordance with claim 1 wherein:

said coupling to said array of sensor elements provides a plurality of subarrays numbering N and correspondingly associated with said sets of sector beams;

said first beamforming means includes beamformers of a number equal to said plurality of subarrays each of said beamformers coupled to one subarray to provide said sector beams within said angular region.

3. A wideband beamformer in accordance with claim 2 wherein said beamformers of said first beamforming means are of the discrete Fourier transform type.

4. A wideband beamformer in accordance with claim 2 wherein each of said time delay circuits includes means for providing time delay by interpolation.

5. A method for forming a beam, which comprises:

positioning a plurality of sensor elements to form sensor element array;

forming a multiplicity of subarrays, all having substantially equal angular coverage, from said sensor element array;

coupling each subarray to a corresponding one of a multiplicity of angular sector phase-shift beamformers, said angular sector phase-shift beamformers having a plurality of output terminals, of equal number for all angular sector phase-shift beamformers, with corresponding output terminals being related to an angular sector within said angular region;

coupling corresponding output terminals to time-delay circuits to time align signals from corresponding output terminals;

coupling said time delay circuits to a subsector phase-shift beamformer having output terminals for phase-shifting said time aligned signals to form a plurality of subsector beams within said angular sector and provide signals representative of each of said subsector beams at a corresponding one of said output terminals.

* * * * *